US008198969B2

(12) United States Patent
Cheng et al.

(10) Patent No.: US 8,198,969 B2
(45) Date of Patent: Jun. 12, 2012

(54) LOW COST CHARGER TRANSFORMER

(75) Inventors: Wo Oi Cheng, Kowloon (HK); Alfredo Grueso, Rizal (PH)

(73) Assignee: Astec International Limited, Kwun Tong, Kowloon (HK)

( * ) Notice: Subject to any disclaimer, the term of this patent is extended or adjusted under 35 U.S.C. 154(b) by 0 days.

(21) Appl. No.: 12/569,980

(22) Filed: Sep. 30, 2009

(65) Prior Publication Data

US 2011/0074532 A1 Mar. 31, 2011

(51) Int. Cl.

| | |
|---|---|
| ***H01F 27/30*** | (2006.01) |
| ***H01F 27/02*** | (2006.01) |
| ***H01F 17/06*** | (2006.01) |
| ***H01F 27/24*** | (2006.01) |
| ***H01F 17/04*** | (2006.01) |

(52) U.S. Cl. ..... 336/198; 336/83; 336/90; 336/178; 336/208; 336/212; 336/221

(58) Field of Classification Search ..... 336/83, 336/90, 178, 198, 208, 212, 221
See application file for complete search history.

(56) References Cited

U.S. PATENT DOCUMENTS

| | | | | |
|---|---|---|---|---|
| 4,443,934 | A | 4/1984 | Hickey | |
| 4,475,097 | A * | 10/1984 | Kikuchi | 336/192 |
| 5,719,546 | A * | 2/1998 | Ito et al. | 336/180 |
| 6,373,367 | B1 * | 4/2002 | Lu | 336/198 |
| 6,980,077 | B1 | 12/2005 | Chandrasekaran et al. | |
| 2003/0080844 | A1 * | 5/2003 | Nishikawa et al. | 336/178 |
| 2004/0246089 | A1 * | 12/2004 | Stephens | 336/212 |
| 2007/0252669 | A1 * | 11/2007 | Hansen et al. | 336/212 |
| 2009/0066454 | A1 * | 3/2009 | Hansen | 336/83 |
| 2010/0026445 | A1 * | 2/2010 | Lin et al. | 336/84 R |

FOREIGN PATENT DOCUMENTS

| | | | |
|---|---|---|---|
| JP | 60-245206 | | 12/1985 |
| JP | 03241801 | A * | 10/1991 |
| JP | 04-091657 | | 3/1992 |
| JP | 05073831 | A * | 3/1993 |
| JP | 2007-067081 | | 3/2007 |
| WO | 2005/004180 | | 1/2005 |

OTHER PUBLICATIONS

NN910416, Ceramic Primary Winding for Planar Transformers, Apr. 1, 1991, IBM Technical Disclosure Bulletin, vol. 33, Issue No. 11, pp. 16-17.*

* cited by examiner

*Primary Examiner* — Lincoln Donovan
*Assistant Examiner* — Tsz Chan
(74) *Attorney, Agent, or Firm* — Harness, Dickey & Pierce, P.L.C.

(57) ABSTRACT

A cost effective integrated automotive solution for a charger transformer with minimized fringing flux and core grounding for reducing electromagnetic interference (EMI). The method provides an air gap filled with a mixture of an adhesive and ferrite powder that bonds the ferrite core sections together. In addition, the ground pin of the transformer is exposed through a groove in the pocket of the bobbin on which the core is mounted and an electrical contact is established between the exposed end of the ground pin and the core surface by means of a drop of epoxy.

7 Claims, 2 Drawing Sheets

LOW COST CHARGER TRANSFORMER

FIELD

The present disclosure relates to the field of transformers. In particular, this disclosure relates to flyback charger transformers.

BACKGROUND

This section provides background information related to the present disclosure which is not necessarily prior art.

A flyback transformer (FBT) or a line output transformer (LOPT) is a type of transformer which operates at a very high switching frequency and generates high voltage. Unlike a mains transformer, a flyback transformer (FBT) or a line output transformer (LOPT) is designed not just to transfer energy, but also to store it for a significant fraction of the switching period. This is achieved by winding the coils on a ferrite core with an air gap. The air gap increases the reluctance of the magnetic circuit and therefore its capacity to store energy. A flyback transformer generates high voltage in the range of a few kilovolts and operates with switched currents at much higher frequencies in the range of kilo-hertz.

The air gap has a very important role in the design of a transformer. Whenever a gap is inserted in a magnetic path there is a fringing flux induced at the gap, which increases with increase in the size of the air gap. Fringing flux decreases the total reluctance of the magnetic path. If the fringing flux is strong enough, it will induce eddy current both in the core as well as the adjoining winding and will cause localized heating resulting in increased losses and consequently failure of the transformer.

There is a requirement for optimizing the air gap of a flyback transformer or any device with energy storage capability in a ferrite core. Typically, flyback transformers use high permeability ferrite core sections made of individual laminations cut in shapes like 'E', 'I' and 'C' that are bonded together. Prior art in creating a gap for E core geometry and the likes is to grind the inner leg or limb of the ferrite core. Another method is to insert a film at the mating face of the two halves of the ferrite cores on the two outer legs or limbs or bond the core sections using a high temperature masking tape such as kapton tape. One more method known in the art is the use of an iron powder block placed at the mating face of the inner leg or limb of ferrite cores to replace the air gap and minimize the fringing flux.

Grounding of the transformer core serves as a solution for EMI (electromagnetic interference) and prior art in core grounding also has a lot of variations. In mobile and imaging industries, faraday's copper plate shield was used in direct contact with the ferrite core and the lead of the ground pin. Over a period of time, faraday's copper plate shield wrapped around the transformer body evolved to just a small piece of copper plate placed on top of the core surface with the lead terminated on the ground pin. This was further simplified by completely removing the copper plate and using conductive epoxy to provide a coupling between the lead terminal (enamel coating is removed or tinned at the end portion of lead) and the core. According to another method, a tinned wire is wrapped around the transformer body and has direct contact with the core surface. Still another method is to provide a special pin having direct contact with the core surface which proved to be an expensive solution.

Various techniques have been used in the art to provide a low cost solution for energy storage in transformers and cost effective core grounding for reduced EMI.

SUMMARY

This section provides a general summary of the disclosure, and is not a comprehensive disclosure of its full scope or all of its features.

According to one an example embodiment, a transformer includes a first ferrite core section and a second ferrite core section. The ferrite core sections are bonded together with a mixture comprising an adhesive and magnetic particles.

According to another example embodiment, a transformer includes a ferrite core, a bobbin adapted to be fitted to the core, a pocket defined in the bobbin for securing a ground pin, a groove defined in the bobbin, the groove exposing one end of the ground pin in close proximity to a surface of the ferrite core, and a conductive adhesive connecting the ground pin to the core via the groove.

According to another example embodiment, a process for assembling a transformer includes mounting a first core section on a fixture, inserting a bobbin into the first core section, applying a compressible filler on one or more mating faces of the first core section, inserting a second core section into the bobbin, and pushing the second core section with a force until a target inductance is reached.

DRAWINGS

The drawings described herein are for illustrative purposes of selected embodiments only and are not intended to limit the scope of the present disclosure.

Corresponding reference numerals/indicia indicate corresponding parts throughout the several views of the accompanying drawings.

DETAILED DESCRIPTION

Figure 1:
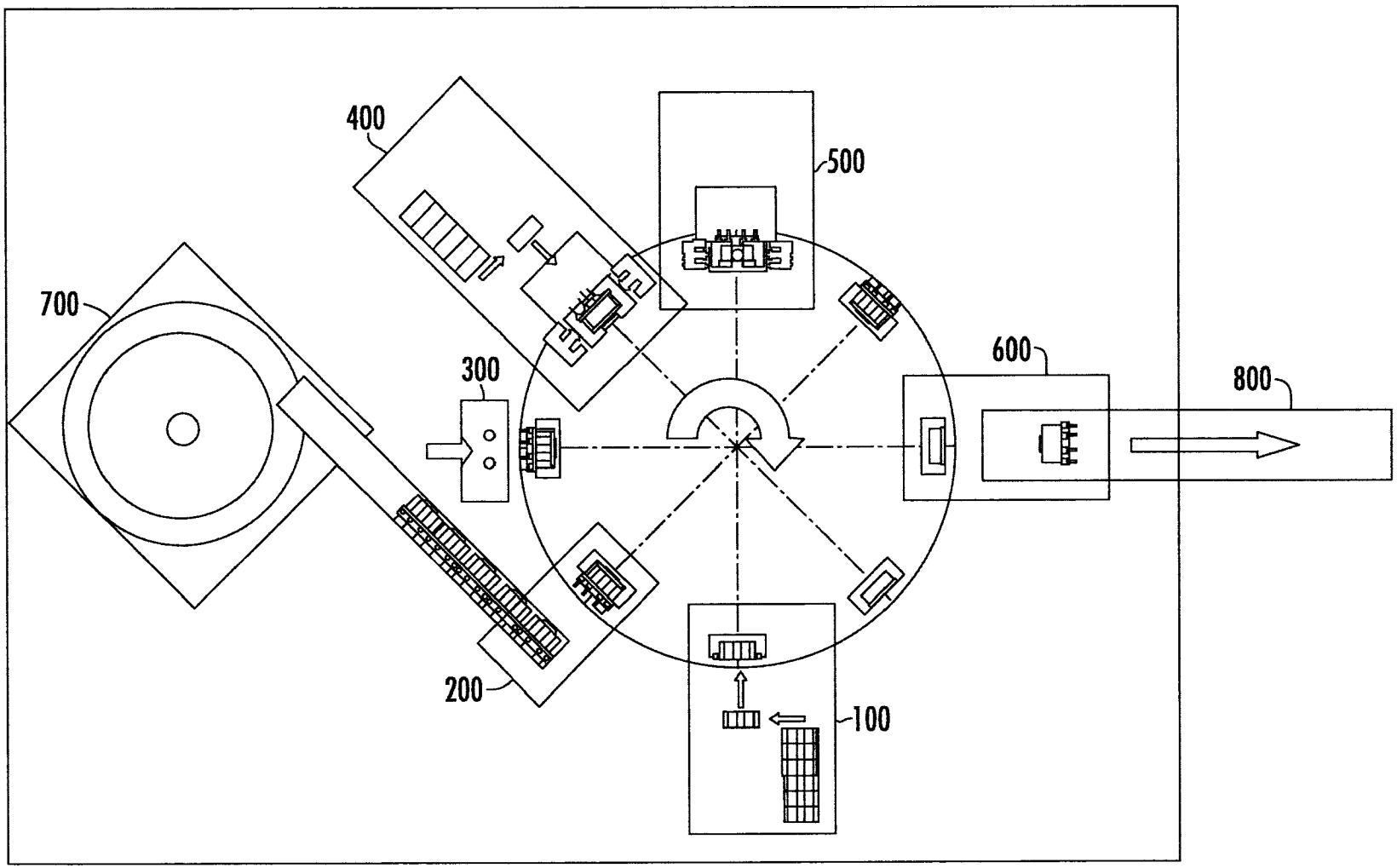
FIG. 1 illustrates a core assembly process for a transformer.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

The present disclosure envisages a cost effective charger transformer design with minimized fringing flux and core grounding for reducing electromagnetic interference (EMI). Fringing flux is the part of the core flux that 'fringes' or leaves the sides of the core and diverges beyond the air gap causing decrease in the total reluctance of the magnetic path. The harmful effects of fringing flux include eddy current losses in the core and the windings adjoining the gap.

The two main cost drivers for a transformer are raw material and assembly/manufacturing cycle time. The transformer design in accordance with the present disclosure firstly includes filling the gap in the transformer core by a mixture of adhesive (epoxy) and ferrite powder, so as to minimize fringing flux. Secondly, the transformer bobbin is adapted to provide a groove for exposing the ground pin. Thus, the core surface can be coupled to the ground pin by using one drop of conductive epoxy, without a need for extra wire.

FIG. 1 illustrates a core assembly process for a transformer. The process as envisaged in accordance with the present disclosure is described herein below with reference to FIG. 1-FIG. 7.

Figure 2:
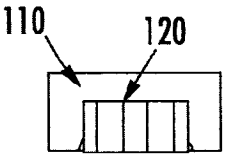
FIG. 2 illustrates core A mounted on a fixture in accordance with a step of the process illustrated in FIG. 1.

A core of a flyback transformer typically consists of two sections, herein referred to as core A and core B, each of the sections having mating faces for coupling the two sections. A core mounting process 100 (shown in FIG. 1) involves mounting of core A on a fixture as shown in FIG. 2, wherein the core A 120 is mounted on the fixture 110. The fixture 110 is a device that provides mechanical support to the transformer core.

Figure 3:
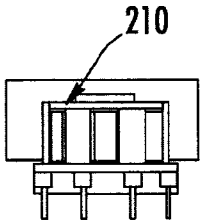
FIG. 3 illustrates a bobbin inserted into core A in accordance with a step of the process illustrated in FIG. 1.

A bobbin insertion process 200 (shown in FIG. 1) involves insertion of a bobbin into the core A as shown in FIG. 3, wherein the bobbin 210 is inserted into the core A. The bobbin 210 serves to align the cores, channel the windings and provide a means for termination of the leads of the transformer.

A parts feeder 700 (shown in FIG. 1) is used to feed the bobbin into the core A as part of the bobbin insertion process 200 (shown in FIG. 1).

Figure 4:
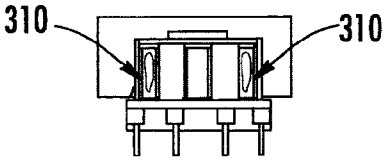
FIG. 4 illustrates core A with glue applied on the mating faces of the outer legs/limbs in accordance with a step of the process illustrated in FIG. 1.

An adhesive application process 300 (shown in FIG. 1) involves application of a mixture 310 of an adhesive mixed with ferrite powder on the mating faces of the outer legs/limbs of the core A as shown in FIG. 4. The ratio of ferrite powder to the amount of adhesive depends on the size of the required gap and ultimately the final inductance for the proper storage function of the transformer without pushing the core into saturation. A predetermined amount of the adhesive mixed with ferrite powder is applied onto the mating faces of the outer legs/limbs of the ferrite core. Ferrite powder and epoxy can be mixed and dispensed using machines and applicators available in the market. Manual mixing is also possible, however it might not be used for high volume production. The epoxy/adhesive can be oven or air cured. A powder of other materials such as moly-permalloy, nickel alloy and the like can also be mixed with an adhesive such as epoxy and used in accordance with the present disclosure.

Figure 5:
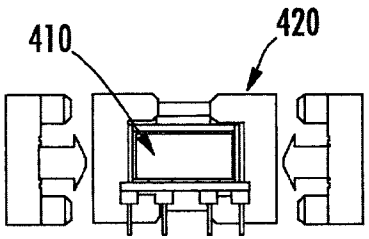
FIG. 5 illustrates core B inserted into the bobbin in accordance with a step of the process illustrated in FIG. 1.

A core insertion process 400 (shown in FIG. 1) involves insertion of the core B into the bobbin as shown in FIG. 5, wherein a finger 420 holds the bobbin in place and core B 410 is inserted into the bobbin. The finger 420 is a retaining means used to hold the core assembly in position.

Figure 6:
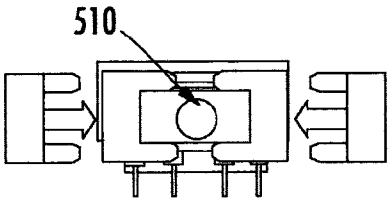
FIG. 6 illustrates the bonding of core A and core B in accordance with a step of the process illustrated in FIG. 1.

A core bonding process 500 (shown in FIG. 1) involves bonding of core A and core B as shown in FIG. 6, wherein a finger holds core A in place. Another finger holds core B in place and vibrates to match the core mating faces. A pusher 510 pushes core B with a force of about 3 kgf until the desired inductance is reached. The core assembly may require certain amount of pressure until the adhesive sets or gets cured. This typically takes about 3 seconds.

Figure 7:
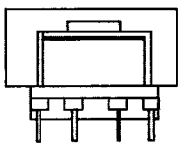
FIG. 7 illustrates an assembled core in accordance with the process illustrated in FIG. 1.

The ejection process 600 (shown in FIG. 1) involves ejection of the assembled core as shown in FIG. 7.

A conveyer 800 (shown in FIG. 1) is used to transport the assembled core to the next processing unit.

Ferrite gapping by method of bonding of the mating faces as illustrated in FIG. 1-FIG. 7 and described herein above, using an adhesive mixed with ferrite powder may eliminate the polyester tapes used to fix the ferrite cores together and the associated processes of the prior art. Likewise it eliminates the grinding process in transformer manufacturing.

The process of core assembly, initial inductance test and application of mechanical pressure can be setup to have an automated core assembly system. The process of fixing the two sections of the core in the automated core assembly system can be as quick as just 5 seconds.

In general, permeability is not a constant, as it can vary with the position in the medium, the frequency of the field applied, humidity, temperature, and other parameters. For instance, ferrite (nickel-zinc) has a permeability of about $20\text{-}800\times10^{-6}$ H/m while ferrite (manganese zinc) has a permeability $>800\times10^{-6}$ when operating in the frequency range 100 kHz~1 MHz. Permeability of the material used has a direct effect on the gap size and tolerance. Hence a predetermined permeability is one of the factors based on which the gap size is determined which again depends on the application for which the device is intended to be used.

For low power devices, wherein the performance of a transformer can be compromised, it is possible to use just an adhesive without a powder in accordance with the present disclosure.

It is also possible to use two epoxy mixtures with different permeability. The lower permeability mixture can be used in the middle leg; while the higher permeability mixture can be used in the outer legs. Thus, the fringing flux can be concentrated in the center leg to reduce losses.

Minimizing of fringing flux in accordance with the present disclosure results in stable inductance with tighter tolerances.

Figure 8:
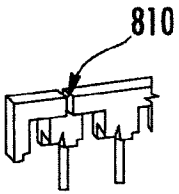
FIG. 8 illustrates a bobbin groove designed to expose the ground pin.

A flyback transformer typically includes approximately 10 to 20 pins each of which has a specific function as part of the complete circuit. The ground pin is the pin of the flyback transformer that is used for grounding the high voltage winding. The solution for reducing EMI in accordance with the present disclosure is described herein below with reference to FIG. 8, wherein a bobbin groove 810 designed to expose an end of the ground pin is illustrated.

To enable the core to be coupled to the circuit ground, the other end of the ground pin of the transformer which is embedded into the bobbin's pocket may be exposed closer to the core. The bobbin's pocket is the receiving cavity that securely holds the ground pin of the transformer. The groove 810 is created on the bobbin's pocket near the ferrite core. There is thus no need to alter the design of the ground pin from the rest of the pins.

The groove 810 is designed in such a way that one drop of conductive epoxy may provide a coupling between the exposed end of the ground pin and the ferrite core. In addition, the conductive epoxy will not easily leak so as not to short the nearby pins which are coupled to other circuit traces on the printed circuit board (PCB).

The material for connecting the core to the ground pin in accordance with the present disclosure has a relatively low resistance and high conductivity like conductive epoxy. Although only a drop of epoxy is sufficient to ground the core surface in accordance with the present disclosure, use of any cheap flexible conductive material to provide a coupling between the core surface and the ground pin is possible. One critical parameter in this design is the force applied to pull out the pin and it should be just adequate enough to pass any mechanical reliability test. The size of the pin and bobbin pin pocket can be changed to suit any desired application.

The process of core assembly and core grounding achieved in accordance with the present disclosure and explained herein above not only serve as a solution for minimizing fringing flux and EMI but also provide a simpler process of manufacturing with better quality and lower cost. This in turn increases throughput yield and requires less operators to manage.

While the present disclosure describes flyback charger transformer requiring a gap to store energy and grounding of the core to minimize the EMI, the present disclosure can be extended to any device requiring energy storage capability in a ferrite core.

A transformer with minimized fringing flux and effective core grounding as described in this disclosure has several technical advantages including but not limited to the realization of:

- a low cost solution for energy storage in transformers without compromising on its performance;
- a cost effective solution for grounding of the transformer core to minimize the Electromagnetic Interference (EMI);
- a simple process for manufacturing of transformers;
- reduced manufacturing cycle time of transformers;
- a reliable, accurate and efficient solution for manufacturing transformers with increased throughput yield;
- eliminating the core fixing polyester tape;
- eliminating the core grinding process which entails pre-grinding of core for surface flatness and batch grinding;
- integration of the initial inductance testing with core gapping and core assembly, thus significantly reduced the manufacturing lead time;
- minimizing the core matching process;
- a cheaper core since a core surface with rough finish is acceptable;
- achieving stable inductance with tighter tolerance;
- less work in-process space occupied during production;
- less operators required for the manufacturing process;
- less manual intervention since the suggested method can be fully automated;
- eliminating the enamel wire lead out and pre-cutting process for grounding of a core;
- eliminating the lead out pre-tin dipping and associated process;
- eliminating the wire hook up or pin termination and associated wire scraps;
- eliminating the need for any special design for the ground pin to achieve contact with core; and
- ability of high speed automotive assemblies.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed:

1. A transformer comprising:

a first ferrite core section having at least two outer limbs and one or more inner limbs; and a second ferrite core section having at least two outer limbs and one or more inner limbs;

wherein the one or more inner limbs of the ferrite core sections are bonded together with a mixture comprising an adhesive and magnetic particles;

wherein the at least two outer limbs of ferrite core sections are bonded together with a mixture comprising an adhesive and magnetic particles;

wherein the mixture bonding the one or more inner limbs has a lower magnetic permeability than the mixture bonding the at least two outer limbs.

2. The transformer of claim 1, wherein the magnetic particles of the mixtures are selected from a group of materials comprising ferrite, iron, moly-permalloy and nickel alloy.

3. The transformer of claim 1, wherein the adhesive of the mixtures is epoxy.

4. The transformer of claim 1, wherein a conductive adhesive is used to establish an electrical coupling between an exposed end of a ground pin and a surface of the first ferrite core section.

5. A transformer comprising:

a ferrite including a first core section and a second core section, each core section having at least two outer limbs and one or more inner limbs;

a bobbin adapted to be fitted to the core;

a ground pin;

a pocket defined in the bobbin for securing the ground pin;

a groove defined in the bobbin, the groove exposing one end of the ground pin in close proximity to a surface of the ferrite core; and a conductive adhesive connecting the ground pin to the core via the groove;

wherein the one or more inner limbs of the ferrite core sections are bonded together with a mixture comprising an adhesive and magnetic particles;

wherein the at least two outer limbs of the ferrite core sections are bonded together with a mixture comprising an adhesive and magnetic particles; and wherein the mixture bonding the one or more inner limbs has a lower magnetic permeability than the mixture bonding the at least two outer limbs.

6. The transformer of claim 5, wherein the conductive adhesive is conductive epoxy.

7. The transformer of claim 5, wherein the conductive adhesive is contained to prevent shorting adjacent pins.

* * * * *